US005188169A

United States Patent [19]

Lim

[11] Patent Number: 5,188,169

[45] Date of Patent: Feb. 23, 1993

[54] HEATER-HUMIDIFIER-DEHUMIDIFIER UNIT

[75] Inventor: Gui Y. Lim, Kyungki, Rep. of Korea

[73] Assignee: Samsung Electronics Co., Ltd., Suweon, Rep. of Korea

[21] Appl. No.: 828,121

[22] Filed: Jan. 30, 1992

[30] Foreign Application Priority Data

Jan. 31, 1991 [KR] Rep. of Korea ..... 91-1695

[51] Int. Cl.[5] ..... F24F 3/147

[52] U.S. Cl. ..... 165/20; 165/21; 165/48.1; 165/122

[58] Field of Search ..... 165/20, 21, 48.1, 124, 165/126, 122; 236/44 C

[56] References Cited

U.S. PATENT DOCUMENTS

| | | | |
|---|---|---|---|
| H229 | 3/1987 | Phillips | 165/96 |
| 843,909 | 2/1907 | Peters et al. | 165/20 |
| 1,819,643 | 8/1931 | Fleisher | 165/21 X |
| 2,545,491 | 3/1951 | Ohlheiser | 165/20 |
| 3,245,461 | 4/1966 | Allington | 165/21 |
| 3,651,864 | 3/1972 | Maddox, Jr. | 165/20 |
| 3,833,052 | 9/1974 | Cardinal | 165/20 |
| 4,750,545 | 6/1988 | Hile et al. | 165/20 |

FOREIGN PATENT DOCUMENTS

| | | | |
|---|---|---|---|
| 61-153426 | 7/1986 | Japan | 165/126 |

*Primary Examiner*—Allen J. Flanigan
*Attorney, Agent, or Firm*—Burns, Doane, Swecker & Mathis

[57] ABSTRACT

An air treating unit comprises side-by-side compartments. An air cooling/dehumidifying mechanism and an air heating/humidifying mechanism are disposed in respective compartments. Selectively actuable fans are disposed in the compartments. The air cooling-/dehumidifying mechanism includes a condenser and a water collecting tank disposed therebelow. The air heating/humidifying mechanism includes a heater and a water vaporizing tank disposed therebelow.

5 Claims, 4 Drawing Sheets

HEATER-HUMIDIFIER-DEHUMIDIFIER UNIT

BACKGROUND OF THE INVENTION

This invention is related to a heater-humidifier-dehumidifier unit, and more particularly to a heater-humidifier-dehumidifier unit which is mounted in respective compartments of a housing.

A lot of air conditioning apparatuses have been developed for providing proper living and working conditions in a defined area in proportion to the size of the particular apparatus. For example, a heater, a cooler, a humidifier and dehumidifier constitute known air conditioning apparatuses. These air conditioning apparatuses are separately manufactured, and each apparatus is chosen to provide a desirable condition in an area to be air-conditioned.

Therefore, air conditioning apparatuses must be bought individually according to the need desired, that is, when warming of the area is desired, a heater is required. When removing moisture from humid air, a dehumidifier is required. When providing proper humidity in dry air, a humidifier is required. Thus, this causes an increase of installment costs, and an increase of dead space due to the occupation of a space by an unused air conditioning apparatus.

Further, the comfort of the space to be air-conditioned deteriorates in proportion to the operation of the air conditioning apparatus. That is, when in the warming operation, air becomes less humid or drier and when in a cooling operation, the air becomes more humid. Hence, a combination unit is required to compensate for the above problems.

SUMMARY OF THE INVENTION

In view of the foregoing problems, an object of the present invention is to provide a single heater-humidifier-dehumidifier unit contained in a single housing in order to minimize the occupying volume thereof.

Another object of the present invention is to provide a combination heater-humidifier-dehumidifier unit which can be utilized regardless of the particular season to provide properly heated and humidified air.

Another object of the present invention is to provide a combination heater-humidifier-dehumidifier unit which operates to compensate for the operation of the other systems.

According to the present invention, the combination heater-humidifier-dehumidifier unit comprises a housing having an air inlet formed in a front wall of the housing and an air outlet formed in a top portion of the housing. The housing has a vertical partition for forming compartments within the housing, and for selectively introducing air flow into the whole and/or part of the housing. One of the compartments is provided with a dehumidifying means, and another of the compartments is provided with a humidifying means. The dehumidifying means consists of a compressor, a condenser, a capillary tube, an evaporator and a condensate collecting receptacle under the evaporator. The humidifying means consists of a storage vessel with an embedded heater in the wall of the vessel for vaporizing water in the vessel. Heating means are provided at both sides of the vertical partition for selectively warming air introduced through the whole and/or part of the housing. Further, the air flow introducing means are provided at both sides of the vertical partition for selectively introducing air flow into the whole and/or part of the housing.

Because the combination heater-humidifier-dehumidifier unit includes a heater, humidifier and dehumidifier in single body housing, the compactness of the unit is increased. Furthermore, the unit of this invention can be utilized regardless of the particular season. One subsystem simultaneously operates to compensate a worsening condition caused by the operation of another subsystem. That is, the unit of the present invention operates to maintain the air in a dwelling, or the like, within a zone or range of comfort.

BRIEF DETAILED DESCRIPTION OF DRAWINGS

DESCRIPTION OF THE PREFERRED EMBODIMENT

Figure 1:
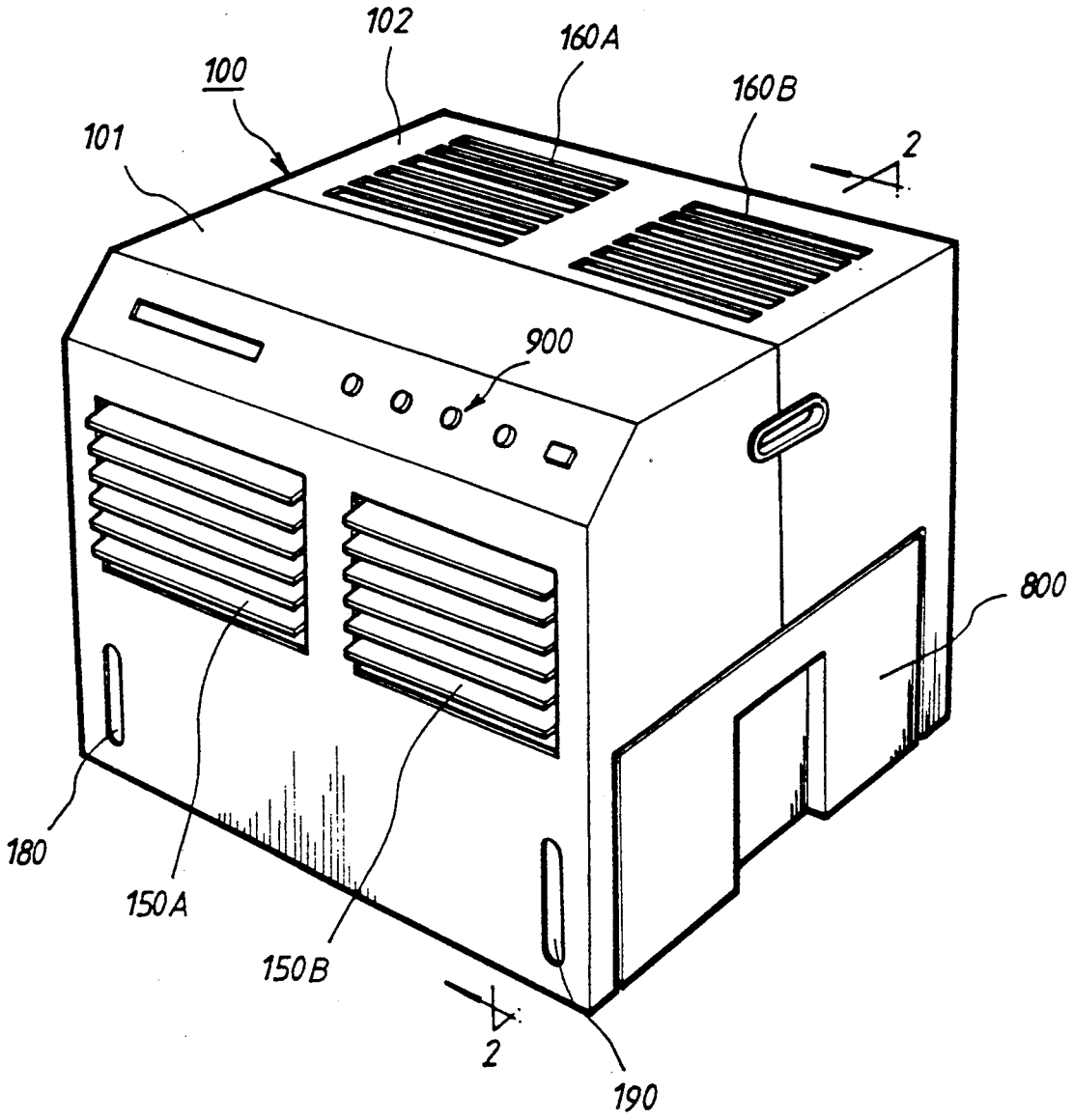
FIG. 1 is a perspective view of the combination heater-humidifier-dehumidifier unit according to the present invention.
Figure 2:
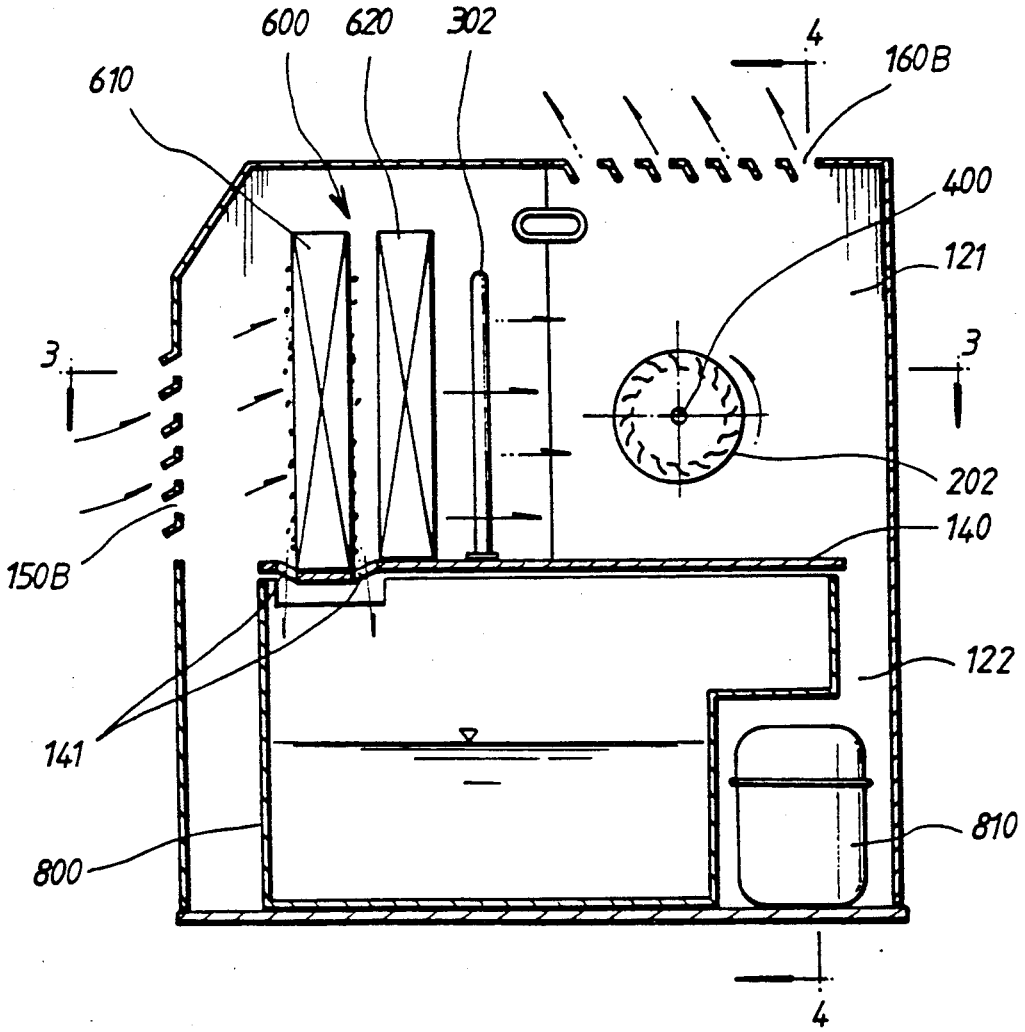
FIG. 2 is a cross section taken on line 2—2 in FIG. 1.
Figure 3:
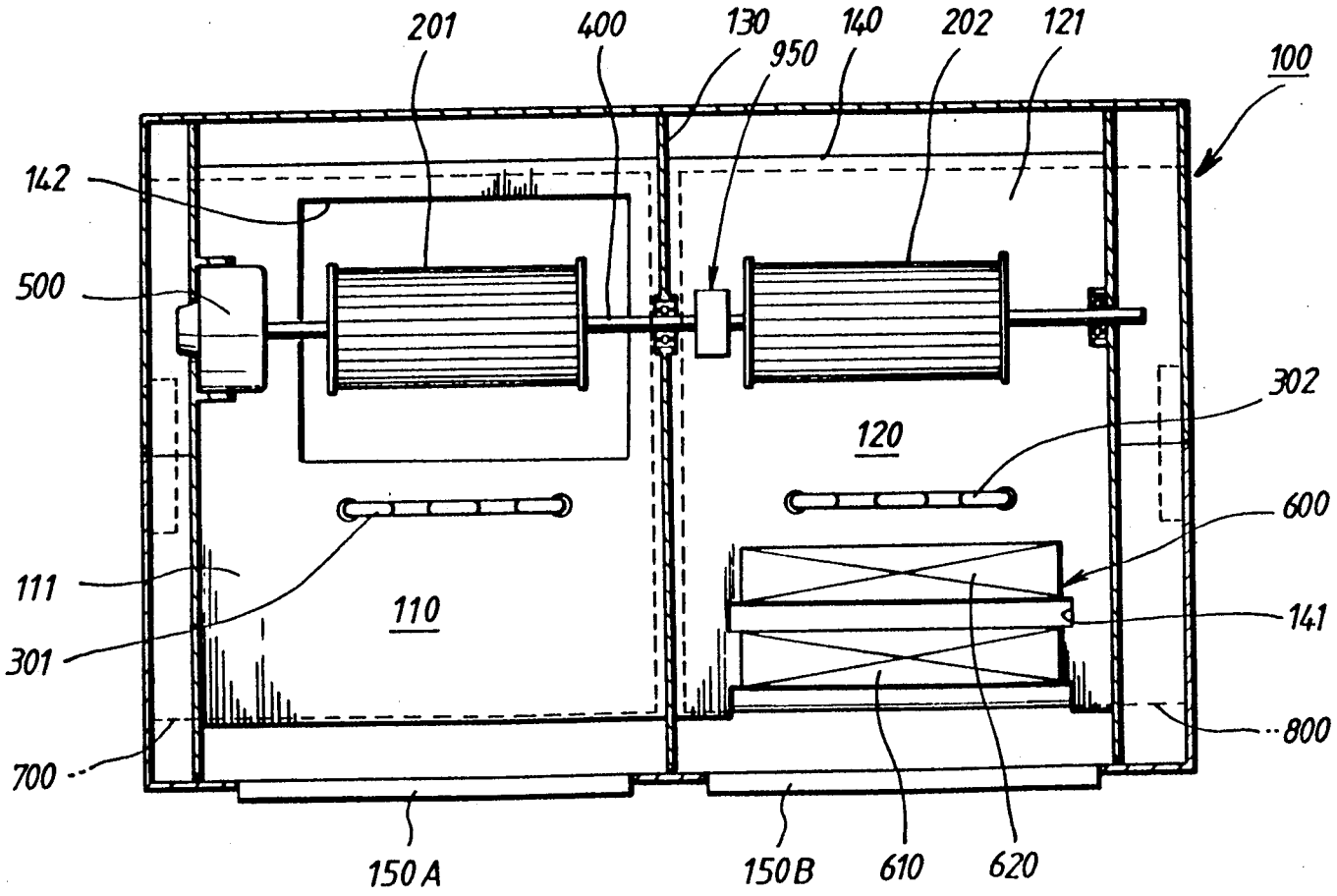
FIG. 3 is a cross section taken on line 3—3 in FIG. 2.
Figure 4:
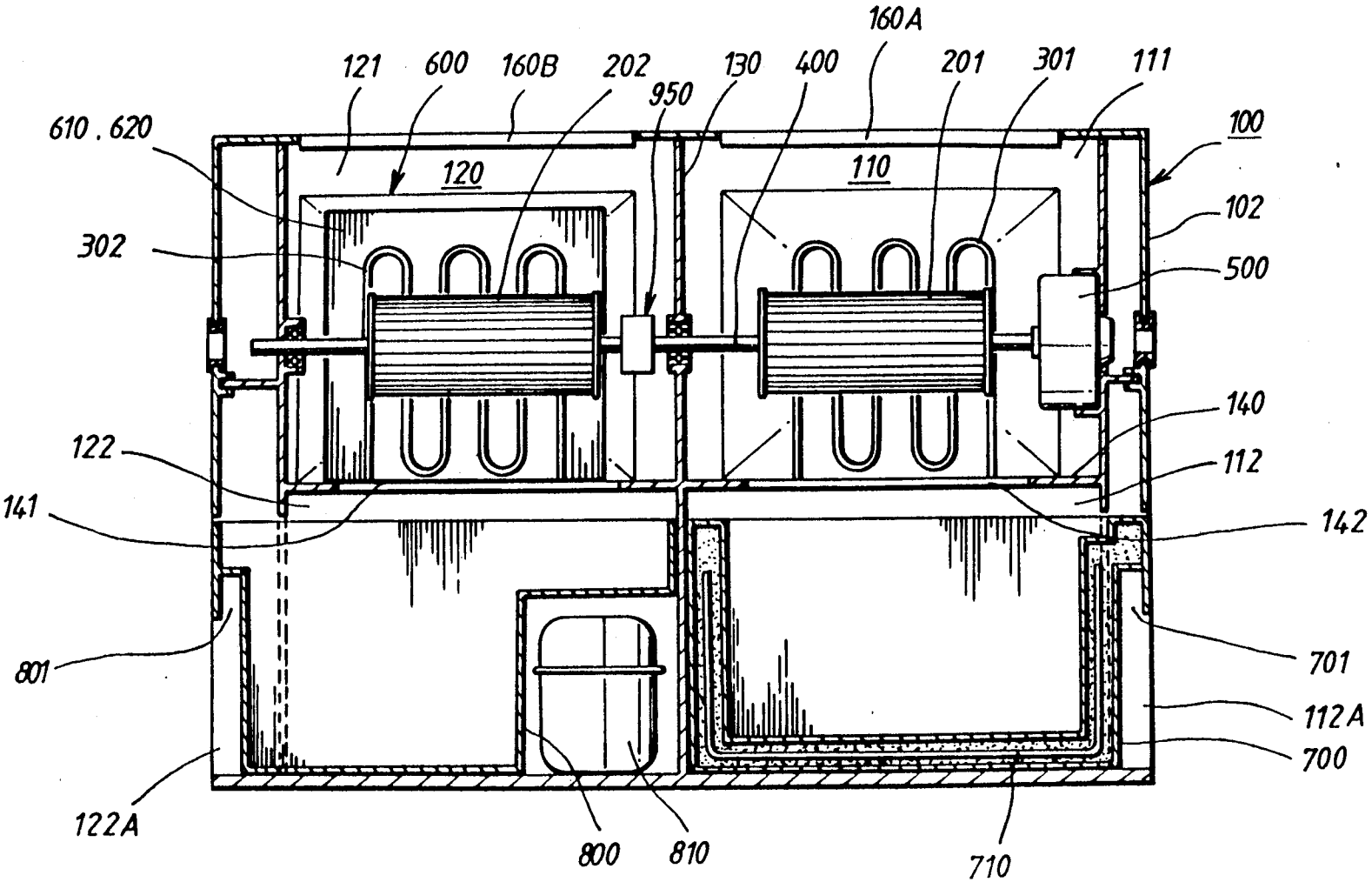
FIG. 4 is a cross section taken on line 4—4 in FIG. 2.

Referring now to FIG. 1, the combination heater-humidifier-dehumidifier unit in accordance with the preferred embodiment of the present invention provides a housing 100 in the shape of hexagon, which encloses a plurality of different functional means. The housing 100 is provided with a front cover member 101 and, a rear cover member 102 which are detachably assembled, thereby furnishing a chamber for allowing air to circulate therethrough. The front cover member 101 and the rear cover member 102 include a common vertical partition 130, FIG. 3, which extends from the ceiling of the housing 100 to the bottom of the housing at approximately the center of the housing 100, thereby providing a left compartment 110 and a right compartment 120. Moreover, the left compartment 110 and the right compartment 120 provide a horizontal partition 140 which extends from one side wall of the housing 100 to the other side wall thereof at approximately mid-height of the housing 100, thereby creating a first chamber 111, a second chamber 112, a third chamber 121, and a fourth chamber 122. Thus, the first chamber 111 and the third chamber 121 are placed at the upper portion of the housing 100 while the second chamber 112 and the fourth chamber 122 are placed at the lower portion of the housing 100. A couple of air inlets 150A,150B are formed in the front wall of the front cover member 101 individually for supplying air into the first chamber 111 and the third chamber 121. A couple of air outlets 160A,160B are formed in the top of the rear wall cover member 102, FIG. 1, for venting the first chamber 111 and the third chamber 121. Under each respective air outlet 160A,160B, fans 201,202, FIG. 3, are installed, and in front of the fans 201,202, heaters 301,302 are respectively placed on the horizontal partition 140. Fans 201,202 are mounted coaxially on a horizontal turning shaft 400 which is rotated by a motor 500, to force conditioned air out of the apparatus and into the space to be air-conditioned. In the right compartment 120 a dehumidifying means 600 is placed. The dehumidifying means 600 comprises an evaporator 610, a condenser 620, a compressor 810 and a capillary tube (not shown). The evaporator 610 and the condenser 620 are provided in the 121. The condenser 620 is placed in the front of the heater 302, and the evaporator 610 is placed in the front of the condenser 620 with the evaporator 610 being positioned farthest from the fan 202. That is, the evaporator 610 and the condenser 620 are interposed between the heater 302 and the air inlet 150B. With this arrangement, air flows sequentially first through the dehumidifying means 600 which transforms moist air to condensated water and dehumidified air, so as to achieve a proper dehumidifying effect. In the second chamber 112 a vaporizing water storage vessel 700 is mounted through an opening 112A which is formed in the side wall of the left compartment 110 as illustrated in FIG. 4. In the fourth chamber 122 a condensating water storage vessel 800 is mounted through an opening 122A which is formed in the side wall of the right compartment 120 as illustrated in FIG. 4. Over the storage vessel 800 a pair of openings 141, FIG. 2, are formed in the horizontal partition 140 for collecting water, which flows from the evaporator 610, down to the vessel 800. Preferably, the openings 141 are formed in the horizontal partition 140 under the bottom of the evaporator 610 along its longitudinal surface. The vaporizing water storage vessel 700 has a heater 710 embedded in a wall thereof so as to vaporize water in order to humidify the air being conditioned. Over the storage vessel 700, an opening 142 is formed in the horizontal partition 140 for passing water vapor produced at the storage vessel 700. Preferably, the opening 142 is formed in the horizontal partition 140 under the fan 201. The vaporizing water storage vessel 700 and the condensating water storage vessel 800 have respective handle portions 701,801 positioned on the respective outside wall of each vessels 700,800. Also, the vessels 700,800, FIG. 4, are made of a clear plastic material to view the respective fluid levels therein. Furthermore, at each lower side portion of the front wall of the front cover member 101 an indicator opening 190 is provided for directly reading the water level of the condensating water storage vessel 800 and an indicator opening 180 is provided for directly reading the water level of the vaporizing water storage vessel 700. At the upper portion of the front wall of the front cover member 101 a group of a individual selective button switches 900 are located. A plurality of casters can be employed on the bottom surface of the combination unit, if desired, in order to easily move the combination unit across the surface of the floor.

The combination heater-humidifier-dehumidifier unit in the present invention operates as follows.

In lower warming operation, when the "low warming" switch, among the button switches 900, is pushed, heater 301 in the first chamber 111 is activated, and the motor 500 operates so as to rotate the fan 201. At this time, the fan 202 does not rotate because clutch 950 mounted on the middle of the shaft 400 is not connected. Air is taken into the first chamber 111 through the air inlet 150A corresponding to the first chamber 111, and flows through the heater 301. The heated air is then forced out through the air outlet 102A corresponding to the first chamber 111, thereby achieving a relatively low warming effect.

In higher warming operation, when the "high warming" switch among the button switches 900 is pushed, the heater 302 in the third chamber 121 as well as the heater 301 in the first chamber 111 is activated, along with the motor 500. At this time, the fan 202, as well as the fan 201, rotates because of the engagement of the clutch 950 operatively positioned on the shaft 400. Besides the air circulation of the first chamber 111 during the low warming operation, additional surrounding air is taken into the third chamber 121 through the air inlet 150B corresponding to the third chamber 121, and flows through the heater 302. The heated air is taken out through the air outlet 102B corresponding to the third chamber 121, thereby achieving a relatively higher warming effect with the relatively larger air volume.

On the other hand, in case the air in the surrounding environment is dry or low humidity due to its warming, the humidity state can be manually selected by pushing the "humidifying" button among the switches 900. Also, where the humidity sensed by a sensor is below a predetermined humidity, the humidifying mode automatically enters into operation by activating the heater 710 embedded in the storage vessel 700. The water in the vessel 700 is then heated by the operation of the heater 710 and is vaporized above the predetermined temperature. The wet air passes up through the opening 142 of the horizontal partition 140 with the aid of the fan 201, and flows through the opening 160A. Thus, the surrounding air is properly conditioned due to the warming and humidification thereof.

In the case where the surrounding air is in an overmoist state as in the summer and, in particular, in the rainy season, the dehumidifying mode can be activated by operating the dehumidifying means 600 provided in the right compartment 120. The dehumidifying means 600 has a conventional cooling cycle which consists of a four step operation, that is, compression, condensation, expansion and evaporation. The moist air, which flows into through the opening 150B, comes into contact with the evaporator 610 and consequently sweat or condensation develops on the elements of the evaporator 160. The condensation drops down along the exterior surface of the elements of the evaporator 610, and through the opening 141 of the horizontal partition 140 is collected in the vessel 800. Thus, the surrounding air is properly conditioned due to being dehumidified.

What is claimed is:

1. An air treating unit comprising:

a housing having air inlet means and air outlet means;

motor-driven air circulating means for circulating air through said housing;

air treating means in said housing including air heating means, air humidifying means, and air dehumidifying means;

said housing having an interior partitioned into a plurality of compartments;

said air humidifying means and said air dehumidifying means being disposed in separate ones of said compartments; and said air circulating means comprising selectively actuable fans disposed in respective ones of said compartments.

2. An air treating unit according to claim 1 including control means connected to said air treating means for individually actuating each of said air heating means, air humidifying means, and air cooling/dehumidifying means.

3. An air treating unit comprising:

a housing having air inlet means and air outlet means;

motor-driven air circulating means for circulating air through said housing;

air treating means in said housing including air heating means, air humidifying means, and air dehumidifying means;

said housing having an interior partitioned into a plurality of compartments; and said air circulating means comprising first and second selectively actuable fans disposed in an upper room of said first and second compartments, respectively.

4. An air treating unit comprising:

a housing having air inlet means and air outlet means;

motor-driven air circulating means for circulating air through said housing;

air treating means in said housing including air heating means, air humidifying means, and air dehumidifying means;

said housing having an interior partitioned into a plurality of compartments;

said air humidifying means and said air dehumidifying means being disposed in separate ones of said compartments;

said air humidifying means comprising a water storage vessel and means for heating said water to vaporize water in said water storage vessel;

said air dehumidifying means comprising a compressor, a condenser, and an evaporator;

said air heating means comprising a heater disposed in said compartment containing said air humidifying means;

said compartments being disposed horizontally adjacent one another; and said air heating means being disposed in an upper room of a second compartment, said water storage vessel being disposed in a lower room of the second compartment, and said water storage vessel communicating with an upper space of said second compartment to admit vaporized water thereto.

5. An air treating unit according to claim 4, wherein said air heating means includes a second heater disposed in said compartment containing said air cooling-/dehumidifying means.

* * * * *